US005911251A

United States Patent [19]

Muscara et al.

[11] Patent Number: 5,911,251

[45] Date of Patent: Jun. 15, 1999

[54] ANTI-SKINNING METHOD AND APPARATUS

[75] Inventors: Dominic Muscara, Iselin, N.J.; Van A Stogner, Hollinston, Mass.; Brian Banks, Stow, Ohio

[73] Assignee: Benjamin Moore & Co., Montvale, N.J.

[21] Appl. No.: 08/885,950

[22] Filed: Jun. 30, 1997

[51] Int. Cl.[6] ..... B65B 1/04

[52] U.S. Cl. ..... 141/100; 141/9; 141/129; 53/474; 53/402

[58] Field of Search ..... 141/9, 100, 103, 141/129, 156, 157; 53/474, 237, 402, 431, 111 RC

[56] References Cited

U.S. PATENT DOCUMENTS 5,323,588 6/1994 Zak et al. ..... 53/411

5,718,268 2/1998 Muscara ..... 141/129

*Primary Examiner*—Steven O. Douglas

*Attorney, Agent, or Firm*—William E. Mouzavires

[57] ABSTRACT

Empty open-top paint cans travelling along a conveyor are filled with paint and a measured amount of an anti-coagulant agent is showered on to the paint surface before closing the cans. The filling of the cans with paint is accomplished at a first processing station and the anti-coagulant is introduced and the closing of the cans is performed at a second processing station. The anti-coagulant dispensing apparatus is switch-activated and employs a shower head for dispensing predetermined quantities without splashing the paint in the cans. The switch is located on the side of the conveyor and is actuated by paint cans contacting the switch during conveyance.

23 Claims, 1 Drawing Sheet

ANTI-SKINNING METHOD AND APPARATUS

BACKGROUND OF INVENTION

In the art of filling paint cans with paint and closing them, a problem can arise when the paint at the top surface of a freshly filled can of paint starts to coagulate forming a thin "skin-like" layer on the top surface of the paint. The above process is known as "skinning" in the industry and can occur in a freshly filled can of paint after it is closed. While "skinning" can occur to various types of paint, latex paint is particularly susceptible to "skinning".

In an attempt to prevent the formation of a "skin" layer in a freshly filled can of paint, one method has been to ladle an anti-coagulant into the can prior to placing a lid on it. This method however slows down the processing time for each can of paint being treated due to the fact that the can assembly line must be stopped each time the anti-coagulant agent is ladled into the can. This method has also proved to be unsatisfactory in that the top surface of the paint in the can may not be substantially covered when the anti-coagulant agent is ladled into the can. The present invention seeks to overcome the above-mentioned problems.

OBJECTS OF THE INVENTION

An object of the present invention is to provide a novel and improved method and apparatus for filling and closing containers with liquids, preferably paints, though the invention need not be limited to paints.

A further object of the present invention is to provide such a novel and improved method and apparatus that may be used in commercial production of paints including the filling and closing of containers with paints.

Another object of the present invention is to provide a novel and improved method and apparatus such as described above which will prevent the formation of a layer of "skin" on the top surface of liquids such as paints after the containers have been filled. Further, included herein is the provision of such a method and apparatus which will achieve the aforementioned objects in a manner which is commercially feasible and without affecting the ambient atmosphere.

SUMMARY OF THE PREFERRED EMBODIMENT OF THE INVENTION

The present invention is preferably applied in conjunction with a conveyor which is transporting open-top cans just filled with paint. An anti-coagulant is added to the top surface of the paint in each can, and lids are subsequently applied to close the cans of paint. In the preferred form of the invention, once a can arrives at a first processing station it is filled with paint, and then it is moved by the conveyor towards a second processing station. Upon reaching the second processing station however the can engages and activates a switch which initiates dispensing of a predetermined amount of anti-coagulant into the can. The can is then closed by having a lid placed on it. The above process continues until all of the cans on the conveyor have been filled with paint, showered or sprayed with a measured amount of an anti-coagulant, and then closed.

In the preferred embodiment of the present invention the cans are filled with paint at the first processing station by a process which employs a filling mechanism as disclosed in U.S. Pat. No. 5,464,047 which is assigned to the Assignee of the present application.

Also in accordance with the preferred embodiment of the present invention, the dispensing apparatus for the anti-coagulant agent is an air-operated pump dispenser which supplies a shower head for spraying the anti-coagulant into the open tops of the paint can without splashing the paint out of the can.

DRAWINGS

Other objects and advantages of the present invention will become apparent from the following detailed description of the present invention taken in conjunction with the attached drawings in which:

FIG. 1 is a side elevational view of an apparatus for filling and closing paint containers in accordance with the present invention with certain parts omitted; and FIG. 2 is a side elevational view of the apparatus shown in FIG. 1.

DETAILED DESCRIPTION

Figure 2:
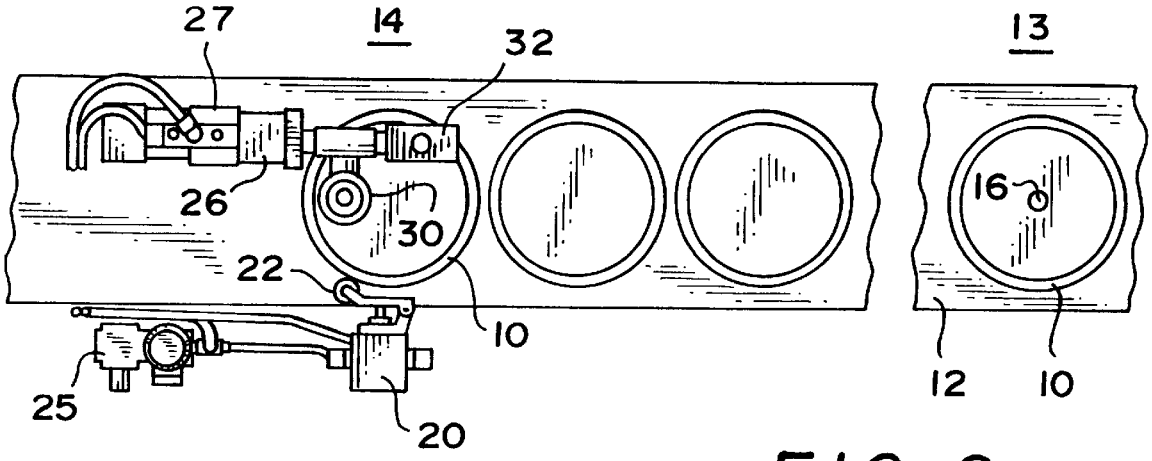

Referring to the drawings in detail there is shown for illustrative purposes only a preferred embodiment of the apparatus of the present invention for performing the method of the present invention.

FIG. 2 shows a conveyor 12 on which empty open-top containers 10 are moved towards a first station 13 where they are stopped momentarily and filled with a liquid product via liquid product dispensing mechanism 16 which employs a jet spray mechanism as disclosed in U.S. Pat. No. 5,464,047 whose disclosure is hereby incorporated by reference into the present application. Also shown in FIG. 2 is a second station 14 to which containers 10 on the conveyor 12 are moved after being filled with a liquid product such as paint at the first station 13. At the second station 14 an anti-coagulant for the paint in the can is introduced into the top of the can via a shower head 30. After receiving anti-coagulant the containers 10 are then closed.

Apparatus for carrying out the above method includes a pneumatic switch 20 having an actuating lever 22 which is engaged by a container 10 upon arriving at the second station 14. Once switch 20 is triggered, an air signal is sent to close an air-operated valve 32 and open valve 32 to discharge anti-coagulant from cylinder 26 through valve 29 and shower head 30 into the container 10 positioned beneath it without splashing paint out of the can. Valves 29 and 32 return to their starting position by means of associated springs (not shown).

Figure 1:
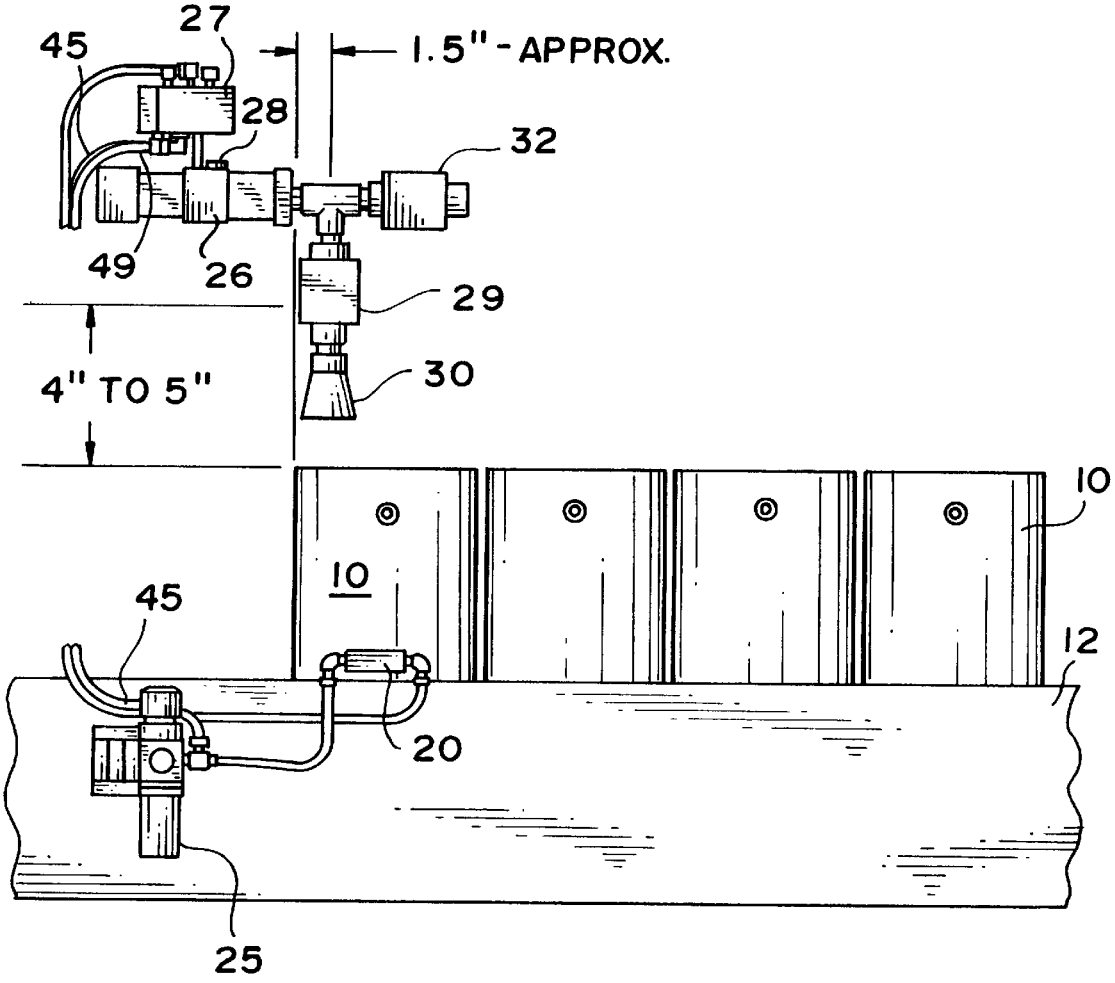

Referring again to FIG. 1, anti-coagulant agent to be sprayed into containers 10 is loaded from a suitable source into dispenser cylinder 26 through valve 32. The volume of anti-coagulant agent that can be held by dispenser cylinder 26 is adjustable. In the preferred embodiment the rate at which the anti-coagulant agent is sprayed or showered by shower head 30 into containers 10 is approximately one ounce of anti-coagulant per 0.1 to 0.2 of a second, while the line speed of the conveyor 12 is 40 to 50 feet per minute. Also in the preferred embodiment the anti-coagulant is comprised of a water mixture that contains propylene glycol, and when it is sprayed into the containers 10, 80% to 90% of the exposed surface area of the liquid in the containers 10 is covered with the anti-coagulant agent. It is further appreciated that the anti-coagulant can be introduced into a container and the container closed at the same station where the liquid product is dispensed into the container.

In the preferred form of the apparatus, the distance from the center of valve 29 to the end of dispenser cylinder 26 is 1.5" (inches) approximately with this distance being adjustable. The distance from the bottom of shower head 30 to the top of container 10 is approximately 4" to 5" (inches) in the preferred embodiment of the invention and is adjustable.

Venting means 28 is affixed to the top surface of dispenser cylinder 26. Also attached to the top surface of dispenser cylinder 26 is diverter valve 27. Attached to the bottom of diverter valve 27 is one end of a compressed air outlet line 49. The other end of compressed air outlet line 49 is attached to the top surface of dispenser cylinder 26 and feeds compressed air into dispenser cylinder 26 when a container 10 travelling on the conveyor engages the switch lever 22. Also attached to the bottom of diverter valve 27 is one end of a compressed air inlet line 45 whose other end is connected to air regulator 25. The air pressure in the air outlet line 49 is approximately 40 to 60 psi.

To summarize the operation of the apparatus of the invention in accordance with the method of the invention, open-top containers 10 having arrived at second station 14 after just having been filled with paint via a jet spray apparatus 16 while at first station 13, make contact with and depress lever 22 of dispenser activation switch 20 which is attached to the side of conveyor 12. Once activated, switch 20 sends an air signal to closed valve 32 and open valve 29 to discharge the anti-coagulant from cylinder 26. The anti-coagulant agent is then directed through shower head 30 and sprayed into the open-top container 10 positioned beneath shower head 30 and the anti-coagulant floats on a substantial surface of the product in the container. The container 10 is then closed.

Although specific embodiments of the invention have been shown and described, other methods and apparatus may be employed within the scope of the invention. Moreover, it will be understood that the scope of the invention is not limited to the specific embodiments disclosed but rather is defined in the appended claims.

What is claimed is:

1. A method of supplying a container with a liquid paint product comprising: dispensing a quantity of the liquid product into the container, introducing a quantity of an anti-coagulant into the container to act as an anti-coagulant for the liquid product in the container, and closing the container.

2. The method of claim 1 where said anti-coagulant is introduced to float on the liquid product in the container.

3. The method of claim 1 where the liquid product and anti-coagulant are introduced into an open top of the container.

4. The method of claim 1 where closing of the container is performed after the anti-coagulant has been added.

5. The method of claim 4 where the anti-coagulant is introduced and the container is closed at the same station where the liquid product is dispensed into the container.

6. The method of claim 1 where the anti-coagulant is introduced and the container is closed at a different station from that where the liquid product is dispensed into the container.

7. The method of claim 6 where the dispensing of the liquid product into the container, the dispensing of the anti-coagulant into the container, and the closing of the container all occur at different stations.

8. The method of claim 1 where the anti-coagulant is dispensed into the container via a shower spray.

9. The method of claim 8 where the shower spray is effected using a shower head.

10. The method of claim 1 where the dispensing of the liquid product and the anti-coagulant, and the closing of the container all occur while the container is on a conveyor.

11. The method of claim 10 where the anti-coagulant is dispensed at a rate of one ounce of anti-coagulant per 0.1 to 0.2 of a second with the line speed of the conveyor being about 40 to 50 feet per minute.

12. The method of claim 1 where the anti-coagulant is dispensed into the container at a ratio of about one ounce of anti-coagulant per gallon of liquid product in the container.

13. The method of claim 1 where the anti-coagulant is comprised of a water mixture that contains propylene glycol.

14. The method of claim 1 where about 80% to 90% of the exposed surface area of the liquid product in the container receives the anti-coagulant.

15. An apparatus for filling a container with a liquid paint product comprising first means for dispensing the liquid product into the container, second and means including a shower head for introducing into the container without splashing a predetermined quantity of an anti-coagulant liquid which acts as an anti-coagulant for the liquid product.

16. The apparatus defined in claim 15 wherein the first and second means introduces the liquid product and anti-coagulant liquid through the open top of the container.

17. The apparatus defined in claim 15 further including a conveyor for transporting the container and wherein filling and closing of the container takes place while the container is on the conveyor.

18. The apparatus defined in claim 17 further including a plurality of spaced stations along the conveyor and wherein said first and second means are located at said stations respectively.

19. The apparatus defined in claim 15 wherein the second means comprises a dispensing pump connected to said shower head.

20. The apparatus defined in claim 19 further including a valve located between the shower head and the dispensing pump.

21. The apparatus defined in claim 20 further including supply means for supplying said pump with said anti-coagulant liquid and a valve between said supply means and said pump.

22. The apparatus defined in claim 22 including a switch engageable by the container for actuating the dispensing pump to dispense the anti-coagulant liquid from the shower head into the container.

23. The apparatus defined in claim 15 including a switch engageable by the container for initiating the dispensing of the second liquid from the shower head into the container.

* * * * *

UNITED STATES PATENT AND TRADEMARK OFFICE

CERTIFICATE OF CORRECTION

PATENT NO. : 5,911,251

DATED : June 15, 1999

INVENTOR(S) : Dominic Muscara, Van A Stogner, Brian Banks

It is certified that error appears in the above-identified patent and that said Letters Patent is hereby corrected as shown below:

Column 4,

Claim 15, Line 3, delete "and" appearing after the word "second" and insert ... and ... before the word ... second ... .

Signed and Sealed this

Ninth Day of November, 1999

*Attest:*

Q. TODD DICKINSON

*Attesting Officer*

*Acting Commissioner of Patents and Trademarks*